US005709297A

United States Patent [19]

Brandriff et al.

[11] Patent Number: 5,709,297

[45] Date of Patent: Jan. 20, 1998

[54] JEWELRY DISPLAY CARD

[76] Inventors: Robert C. Brandriff, 110 Creamery Brook Rd., Brooklyn, Conn. 06234; Bertrand H. Mountford; B. Jason Mountford, both of 20 Cranberry Ridge Rd., N. Scituate, R.I. 02857

[21] Appl. No.: 625,191

[22] Filed: Apr. 1, 1996

[51] Int. Cl.[6] ..... B65D 73/00

[52] U.S. Cl. ..... 206/6.1; 206/806; 206/813

[58] Field of Search ..... 206/6.1, 586, 566, 206/784, 813, 525.1, 495, 806

[56] References Cited

U.S. PATENT DOCUMENTS 3,823,867 7/1974 D'Luhy et al. ..... 206/813 X 4,883,179 11/1989 Dionne ..... 206/523

5,092,465 3/1992 Weder et al. ..... 206/813 X

*Primary Examiner*—Jacob K. Ackun

*Attorney, Agent, or Firm*—Lane, Aitken & McCann

[57] ABSTRACT

A hanger display card for jewelry is made entirely from one piece of paper, having a hanger portion to which a hot-melt adhesive is adhered to stiffen and maintain the shape of the hanger portion. Information including machine-readable type information is applied to sheets to be formed into the hanger display cards, and sheets on which the information is not, in fact, machine readable are culled.

13 Claims, 2 Drawing Sheets

JEWELRY DISPLAY CARD

BACKGROUND OF THE INVENTION

The present invention relates to a point-of-sale jewelry display card and a method for making the same.

Display cards are used for women's earrings and other small, high volume costume jewelry items, and are often used in conjunction with a dedicated, rigid plastic display on top of a display counter in a department store or other retail store. A typical known display card is fabricated from extruded or heat-formed monochromatic plastic stock and is shaped to include a short top panel folded-back from a front panel, with an additional short lip extending down from the top panel, parallel to the front panel of the card. The top panel and the lip define a hanger to allow the card to be suspended from a rail in the display. The display typically includes a plastic edge over which the hanger portion of the card slips. The hanger design has led to a trade reference to this type of display card as a "hanger card". In some cases, a second lip or a slot is included to make removal of the card difficult and, thereby, reduce pilferage.

The use of monochromatic plastic has limited the ability to decorate the visible areas of the display card. A solution has been the application of printed paper laminates to portions of the exposed surfaces of the card. These laminates, with a relatively expensive pressure sensitive adhesive backing, are applied to the face of the card to provide a decorative background, brand identification, etc. Additional adhesive-backed labels are used to include bar codes and pricing. The cost of the pressure sensitive laminates and labels, and the labor cost for label application exceed the base cost of the card. furthermore, in recent years there has been an increased demand for packaging materials that are environmentally friendly and/or recyclable. The plastic used in the known card is not easily recycled due to the contamination from the laminates, as well as the difficulty in identifying the types of plastics contained in discarded cards.

SUMMARY OF THE INVENTION

By the present invention, a display card having a hanger portion is formed completely from paper. The all-paper nature of the card allows the stock material which is to be made into cards, for example, stock material in continuous roll form, to be printed. As a result, all surfaces of the cards can be pre-printed with all desired information, such as logos, bar codes, etc.

In addition, thermal bar code printing can be used for short run items where press printing of bar codes may not be desirable. The information to be printed by thermal bar code printing devices can be changed quickly and easily. Bar code verification can be accomplished as a process step to assure high product quality by avoiding unreadable or incorrect bar codes. Bar code verification can be performed on printed sheets prior to the formation of the hangers, and sheets containing bar codes which are not readable or are otherwise unacceptable can be culled. Moreover, the cards according to the present invention can be used on the same displays as conventional display cards.

In order to produce the display cards according to the present invention, a web of stock material from a roll is passed through a printing press. In one continuous process, one or both surfaces of the material can be printed, cut-outs made, patterns embossed, and fold lines scored. As a last step, individual flat sections, each of which will define a display card, can be severed or sheeted from the web and magazine-stacked for subsequent processing. As an alternative last step, the material can be re-rolled for intermediate storage prior to the severing or sheeting.

The printing and processing steps used in making the display cards according to the present invention allow for the high level of mechanization and automation typically found in the printing trades. This fact, in addition to the lower cost of the paper base material relative to plastic, results in a savings in product manufacture of over 50%. The prepared stock, that is, stock already printed, cut out, embossed and scored, in either sheet or roll form, is processed in a dedicated system to form the finished card. Each card is individually separated and passed into the finishing system. The hanger is formed by bending, which can be done in a conventional way, and the finished cards exit the system and are either bulk packed or shingled for layered packing.

Thin beads of a rigid material are applied in the pre-scored corners of the hanger to thicken, stiffen and reinforce the hanger. Without this reinforcement, the paper would not retain the needed hanger configuration. The reinforced corners are of sufficient strength to allow the use of the paper card on the same displays as plastic cards. The reinforcing material can be a commercially available thermo-plastic hot-melt adhesive or similar material.

DETAILED DESCRIPTION OF THE PREFERRED EMBODIMENTS

Figure 1:
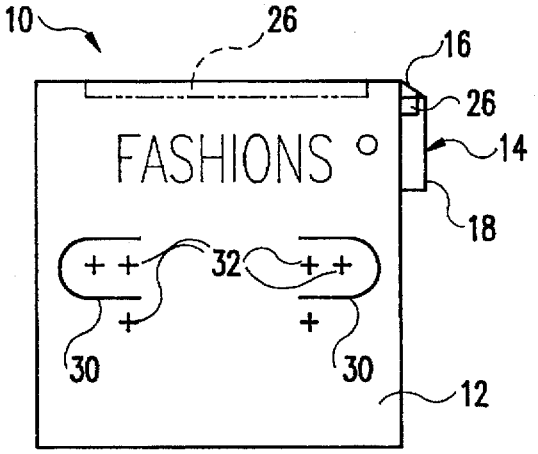
FIG. 1 is a perspective view of the hanger display card according to the present invention.

The hanger display card according to the invention, which is designated generally by the reference numeral 10, is made entirely of paper, such as paper board, which is sometimes called "board". As can be seen from FIGS. 1 and 2, the display card 10 includes a front panel 12, and a hanger 14 comprising a short top panel 16 oriented at a generally right angle to the front panel 12 and a lip 18 extending downward from the top panel 16 at a generally right angle, spaced from and generally parallel to the front panel. The display card 10 is made from one piece of paper.

A reinforcing material 20 is applied to the display card in the region including corners 22 and 24 defined, respectively, between the front panel 12 and the top panel 16 and between the top panel and the lip 18. The reinforcing material 20 comprises, for example, a commercially available thermoplastic hot-melt adhesive, such as HM-1478 adhesive, which is a moderately fast, firm setting material with good adhesive characteristics of the H. B. Fuller Company. The reinforcing material 20 can be in the form of two beads 26, one bead extending along the corner 22 between the front panel 12 and the top panel 16, over a substantial portion of the width of the display card 10, and the other bead being positioned in the corner 24 between the top panel 16 and the lip 18 for a substantial portion of the width of the display card. Score lines 28 (FIG. 4) are formed in the material of the display card 10, for example, along the inside of the corner 22 between the front panel 12 and the top panel 16 and the inside of the corner 24 between the top panel 16 and the lip 18. The score lines can be formed in either the inside surface of the corners 22 and 24, in the outside surface of the corners, or both. U-shaped slits 30 and small x-shaped slits 32 are cut through the front panel 12 to facilitate the mounting of earrings, other jewelry, or other merchandise on the display card 10. Slits and cut-outs of other shapes can be used.

Figure 4:
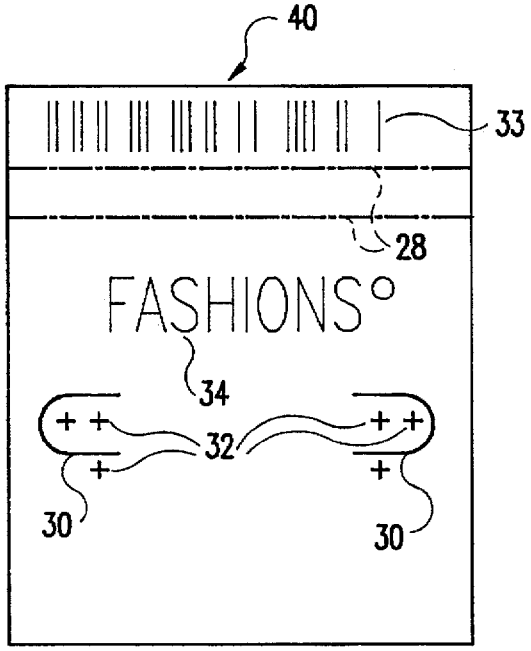
FIG. 4 is a plan view of a sheet cut from the web of FIG. 3.

As can be seen from FIG. 4, information and designs can be printed on the front panel 12, as well as on the top panel 16 and the lip 18. The underside of the web, as viewed in FIG. 3, can also be printed. The printed information can include machine-readable information, such as bar codes 33, inventory information and, sometimes, pricing information. The printed information can also include other information 34, such as logos and other source information. All of the surfaces of the display card 10 accept printing easily, since the display card is made entirely of paper.

Figure 2:
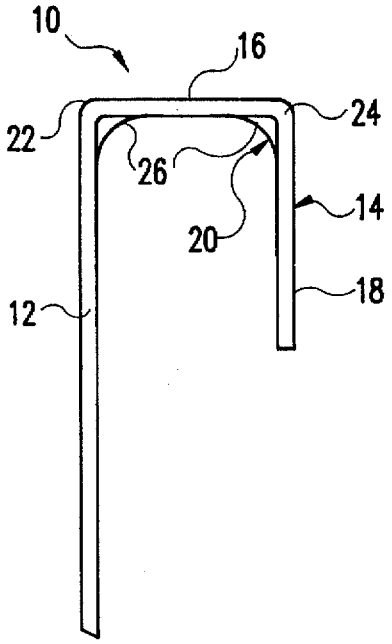
FIG. 2 is an enlarged fragmentary side view of the hanger display card of FIG. 1.
Figure 3:
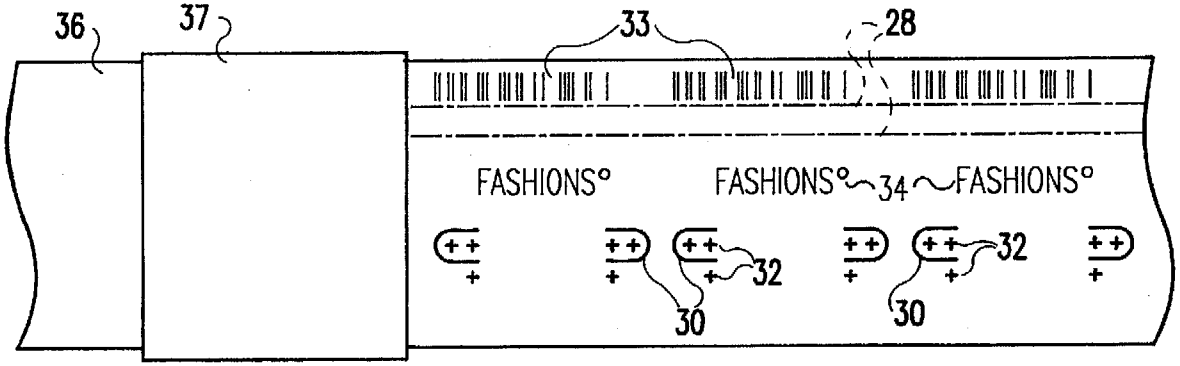
FIG. 3 is a plan view of a portion of a web of stock material imprinted and slit in accordance with the present invention.

As can be appreciated from FIG. 3, the hanger display cards of FIGS. 1 and 2 are made from a web 36 of paper, such as from a supply roll, which is fed through a plurality of steps for forming the hanger display cards 10. The web 36 is fed through machines, represented schematically at 37, which contain conventional elements for printing designs and information, including the machine-readable information 33 and the other information 34, for scoring the web 36 to facilitate bending, and for cutting slits, such as the U-shaped slits 30 and the x-shaped slits 32, through the web. All of the printed information, including bar codes, price points and other point of sale information can be printed simultaneously. The web 36 can be scored on the underside, the top or back.

Figure 5:
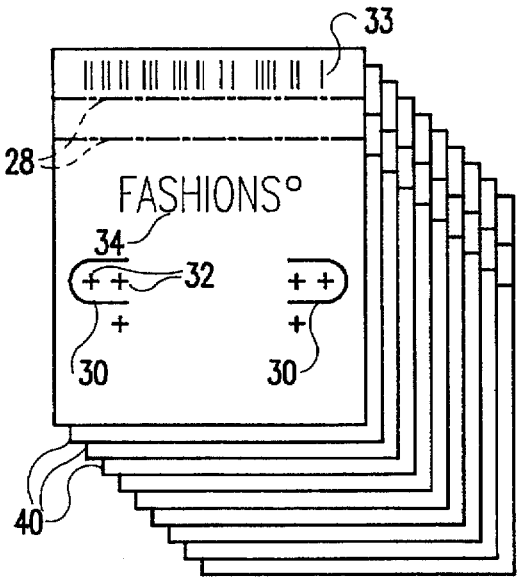
FIG. 5 is a schematic illustration of a plurality of sheets like the sheet of FIG. 4 stacked in a magazine for storage and/or feeding.

Upon leaving the machines 37, the web 36 of material, from which an indeterminate number of the display cards 10 will be made, contains the printing and slits described above. The web 36 can be rewound into a take-up roll for later finishing, or, as can be appreciated from FIGS. 4 and 5, it can be cut into sheets 40, each sheet to form one display card 10. As is represented schematically in FIG. 5, the sheets 40 can be stacked and stored in a magazine of conventional structure for later finishing, or the sheets 40 can be moved along immediately for further processing. If the web 36 is rewound into a take-up roll, cutting the web into sheets 40 is the next step of the later finishing.

As an alternative to printing the bar codes 33 with the other information 34, the bar codes 33 can be applied by thermal transfer. Thermal transfer is preferable where short runs of the cards 10 are being made, since the bar codes 33 can be changed more easily with a thermal transfer device than with devices for other types of printing.

Figure 6:
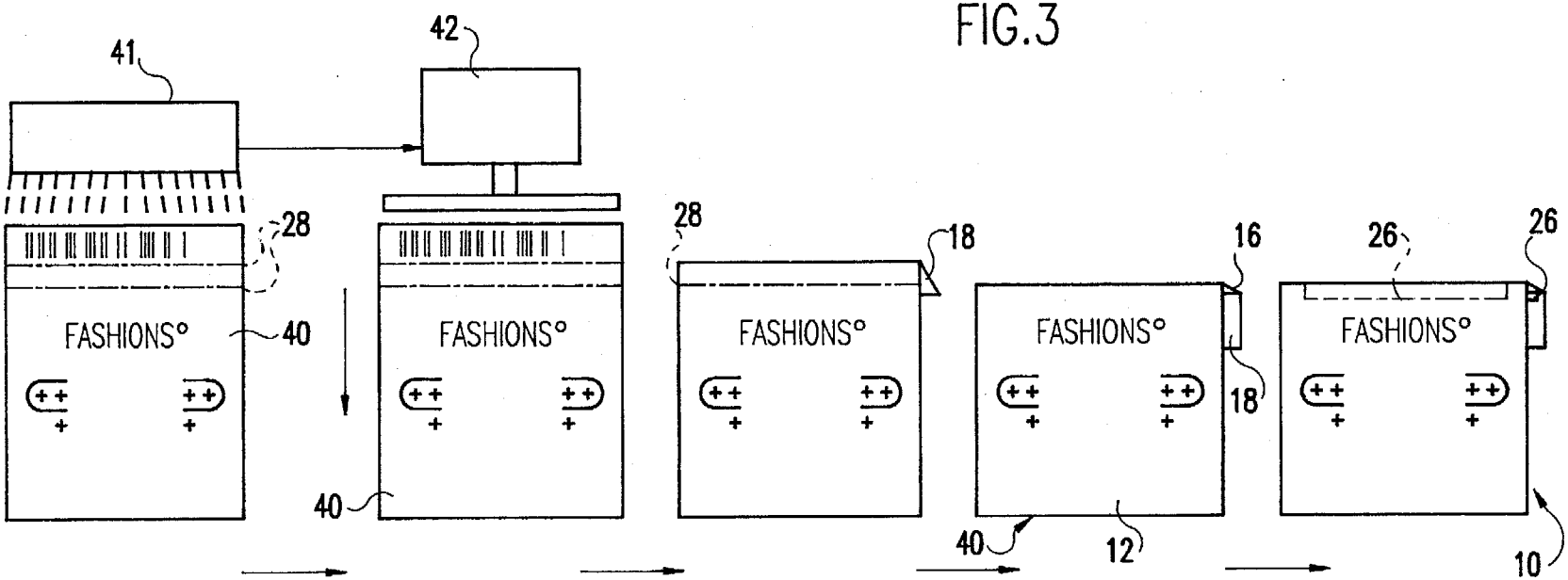
FIG. 6 is a schematic illustration of stages in the formation of hanger display cards according to the present invention from the sheets of FIG. 5.

As can be seen in FIG. 6, when the material is in the form of the sheets 40, the sheets 40 are passed through a bar code reader 41 of a known type for verification that the bar codes 33 are readable and correct. In response to a signal from the bar code reader 41, a sheet culling device 42 removes sheets whose bar codes are unreadable or incorrect from the stream of sheets 40 moving through the bar code reader 41. The accepted sheets move along by conveyor to conventional mechanical elements which first fold back the lip 18 along one of the score lines 28 at approximately a 90° angle with respect to the rest of the sheet 40 and then, along the other score line 28, fold back the top panel 16 with respect to the remainder of the sheet 40, which defines the front panel 12. The folding causes the lip 18 to be spaced from and generally parallel to the front panel 12 and forms a hanger on the sheet 40. The beads 26 of the reinforcing material 20 are applied to the sheet 40, one bead along the corner 22 defined by the juncture of the front panel 12 and the top panel 16, and the other bead along the corner 24 defined by the juncture of the top panel 16 and the lip 18. Each bead 26 extends most of the width of the display card 10. The adhesive nature of the reinforcing material 20 retains the top panel 16 in its angular relationship with respect to the front panel 12, and retains the lip 18 in its angular relationship with respect to the top panel 16. The reinforcing material 20 also makes the card 10 thicker, more rigid, and more resistant to deformation in the region of the hanger 14.

The sheets can be fed from the magazine for the bar code verification, folding, and reinforcing steps. The strip can move from press printing into the sheeting step and then directly into the bar code verification, folding and reinforcing steps.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

We claims:

1. A hanger display card comprising:

a first panel;

a hanger integral with said first panel, including a second panel extending in an orientation generally transverse to said first panel, said second panel defining a first corner with said first panel, and a lip extending in an orientation generally transverse to said second panel and generally parallel to said first panel; and means for maintaining the orientation of said second panel relative to said first panel and the orientation of said lip relative to said second panel, wherein said first panel, said second panel and said lip all are made entirely of paper.

2. The hanger display card of claim 1, wherein said means for maintaining comprises reinforcing material secured to said hanger display card at said first and second corners.

3. The hanger display card of claim 2, wherein said reinforcing material comprises a first bead in said first corner and a second bead in said second corner.

4. The hanger display card of claim 2, wherein said reinforcing means comprises hot-melt adhesive adhered to said hanger display card.

5. The hanger display card of claim 1, wherein said first panel, said second panel and said lip are made from one piece of paper.

6. The hanger display card of claim 1, further comprising means on said first panel for attaching merchandise to the hanger display card.

7. The hanger display card of claim 6, wherein said maintaining means comprises means for stiffening said hanger.

8. The hanger display card of claim 6, wherein said means for attaching merchandise comprises at least one slit in said first panel.

9. The hanger display card of claim 1, further comprising matter printed on said paper.

10. A hanger display card comprising:

a first panel;

a hanger integral with said first panel, including a second panel extending in an orientation generally transverse to said first panel, said second panel defining a first corner with said first panel, and a lip extending in an orientation generally transverse to said second panel and generally parallel to said first panel and defining a second corner with said second panel; and means for maintaining the orientation of said second panel relative to said first panel and the orientation of said lip relative to said second panel, wherein said first panel has a first edge remote from said first corner and a first dimension from said first corner to said first edge, and said second panel has a second edge remote from said second corner and a second dimension from said second corner to said second edge, said first dimension being greater than said second dimension.

11. The hanger display card of claim 10, wherein said first dimension is at least twice said second dimension.

12. The hanger display card of claim 10, further comprising means on said first panel for attaching merchandise to the hanger display card, said attaching means comprising at least one slit in said first panel.

13. A hanger display card comprising:

a first panel;

a hanger integral with said first panel, including a second panel extending in an orientation generally transverse to said first panel, said second panel defining a first corner with said first panel, and a lip extending in an orientation generally transverse to said second panel and generally parallel to said first panel; and means for maintaining the orientation of said second panel relative to said first panel and the orientation of said lip relative to said second panel, wherein said first panel and said hanger define a straight channel having open opposite ends.

* * * * *